United States Patent [19]

Casper et al.

[11] Patent Number: 4,572,496

[45] Date of Patent: Feb. 25, 1986

[54] TRIM REWINDER WITH AUTOMATIC STOP

[75] Inventors: Mark S. Casper, Williamsville; Robert I. Thomson, Pendleton, both of N.Y.

[73] Assignee: Moore Business Forms, Inc., Grand Island, N.Y.

[21] Appl. No.: 530,201

[22] Filed: Sep. 8, 1983

[51] Int. Cl.[4] ..... B65H 41/00

[52] U.S. Cl. ..... 270/52.5; 242/156.2; 242/190

[58] Field of Search ..... 270/52.5; 242/156.1, 242/156.2, 81, 190, 75.1, 77, 189, 41

[56] References Cited

U.S. PATENT DOCUMENTS

| | | | |
|---|---|---|---|
| 30,725 | 11/1860 | Estes | 242/156.1 |
| 2,019,857 | 11/1935 | Hoover | 242/81 |
| 2,288,350 | 6/1942 | Gollwitzer | 242/75.1 X |
| 2,594,800 | 4/1952 | Ranney | 242/81 X |
| 3,117,742 | 1/1964 | Trombetta | 242/156.2 |
| 3,137,767 | 6/1964 | Axon et al. | 242/190 X |
| 3,533,571 | 10/1970 | Turner et al. | 242/77 |
| 3,595,497 | 7/1971 | Boatright | 242/156.1 X |
| 3,690,591 | 9/1972 | Opelt | 242/190 X |
| 3,788,572 | 1/1974 | Wroblewski | 242/189 X |
| 3,857,557 | 12/1974 | Gill et al. . | |
| 4,175,711 | 11/1979 | Kamp | 242/41 X |

*Primary Examiner*—E. H. Eickholt

*Attorney, Agent, or Firm*—Allegretti, Newitt, Witcoff & McAndrews, Ltd.

[57] ABSTRACT

A trim rewinder eliminates manual removal of trim, and increases rewinder capacity several fold. A stripper portion of a bin of the rewinder strips wound trim from elongated members of the rewinder into the bin as the bin is removed. A pressure member wipingly presses trim tightly about the elongated members to compact the trim.

4 Claims, 3 Drawing Figures

TRIM REWINDER WITH AUTOMATIC STOP

BACKGROUND OF THE INVENTION

This invention relates to web handling apparatus, and more particularly to decollating and bursting machines.

Known decollating and bursting machines slit marginal feed strips, stubs or trim from continuous business form assemblies when the forms of the assemblies are to be separated. The machine of U.S. Pat. No. 3,857,557 issued Dec. 31, 1974, has a tray and rewind mechanism for collecting and rewinding stubs. The stubs fall into the tray until the tray is at least partially filled. The stubs then snag on rotating rods of one type of rewind mechanism, or on the tubes of another rewind mechanism, and are wound thereabout. Later, the stubs on this first type mechanism are removed from the rods by being manually pulled therefrom. Stubs on the second type mechanism are also manually pulled off, but more conveniently, after the tubes have been removed from the mechanism. In either type, the stubs must be manually stripped from the mechanism, and transferred or carried some distance to a waste bin. This handling is at best inconvenient and not highly efficient. In addition, the handling results in the stubs being loosened from a tight wrap on the rods or tubes, and occupying large volumes of bin space. Further the mechanisms operate at high speeds, and require torque controls to assure the prevention of web breakage to allow winding.

SUMMARY OF THE INVENTION

In a principal aspect, this invention is a trim rewinder comprising a frame, rewind means including elongated members rotatably mounted on the frame for rewinding trim, and a bin removably mounted on the frame and adapted to strip the trim from the elongated members into the bin, upon removal of the bin.

In another principal aspect, the invention is a trim rewinder comprising a frame, rewind means including elongated members rotatably mounted on the frame for rewinding trim, and a compacting means including a pressure member movably mounted on the frame for compacting the trim on the elongated members.

The invention has a range of objects, advantages and features, including the elimination of manual stripping of trim from the mechanism, rewind capacity increased several fold over existing mechanisms occupying the same space, operation at low rpm without torque control devices, and elimination of the need for manual transfer of the wound trim to a bin.

BRIEF DESCRIPTION OF THE DRAWING

The preferred embodiment of the invention will hereafter be described in relation to the accompanying drawing. The figures of the drawing are as follows.

DETAILED DESCRIPTION OF THE PREFERRED EMBODIMENT

Figure 1:
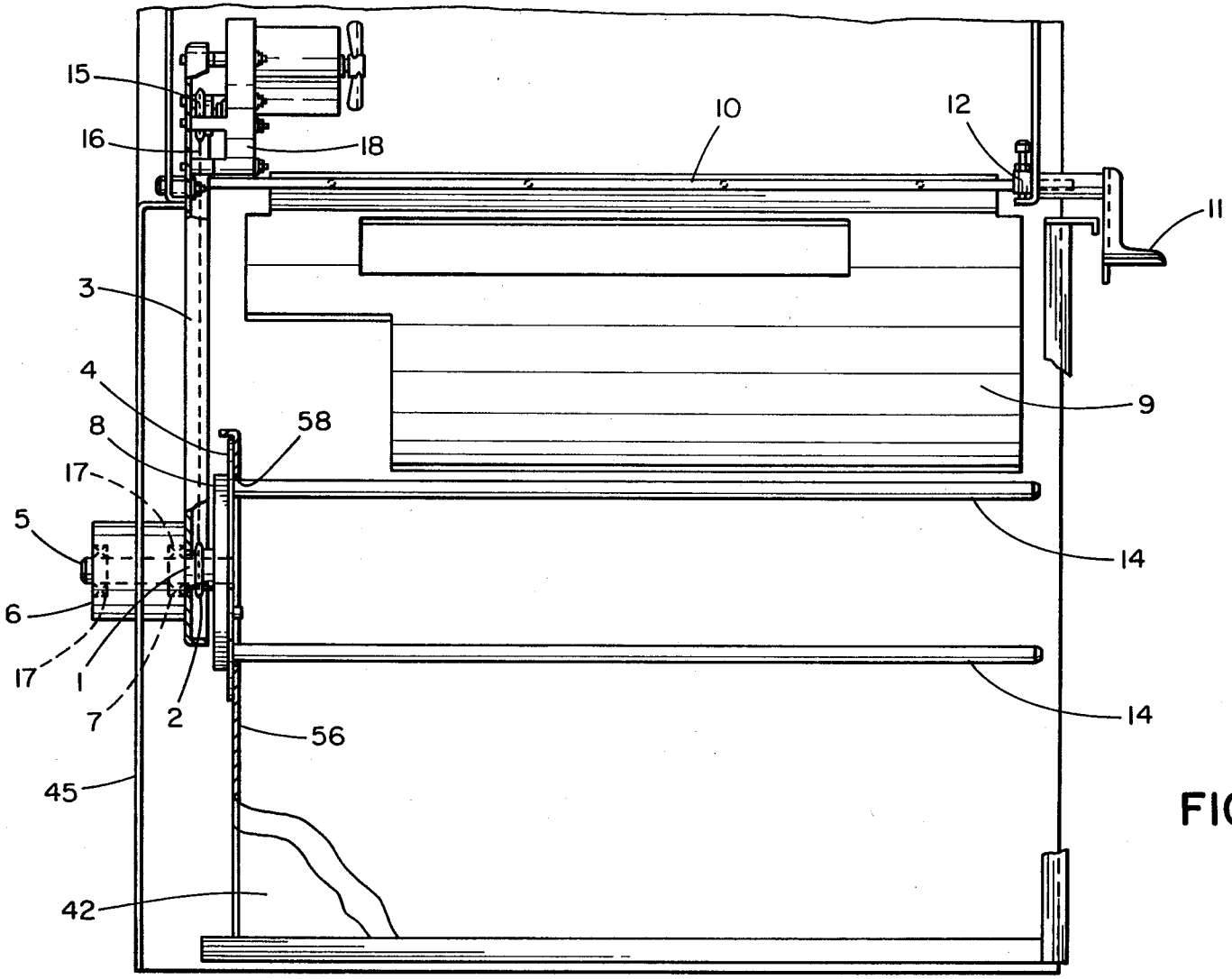
FIG. 1 is a side elevation view of a preferred embodiment of the invention, with a bin thereof cut away to reveal internal detail.

Referring to FIG. 1, the preferred embodiment of the invention is a trim rewinder having two elongated trimwinder rods 14 mounted with a cover plate 4 on a trimwinder plate 8 and thereby to a shaft 5 for rotation about the shaft 5. Bearings 17 support the shaft 5 within bearing housings 6, 7 to a frame member 45. A sprocket 2 and spacer 1 are between the inner bearing housing 7 and the plate 8, on the shaft 5. A trimwinder channel 3 attached to the inner bearing housing 7 encases the sprocket 2, a cooperating chain 16 and a second sprocket 15. A gearmotor 18 attached to the trim rewinder frame drives the sprocket 15, and through the chain 16, the sprocket 2, plate 8 and rods 14. The motor 18 drives the rods 14 at about 6 rpm, with high torque.

A pressure plate 9 extends at rest in a plane parallel to and offset from the axis of the shaft 5. The plate 9 is securely mounted along one side parallel to the shaft axis, to a pressure plate rod 10. The rod 10 is rotatably mounted to the frame, with one end mounted through a stop block 12. At the stop block end, the rod 10 is fitted into a pressure handle 11.

Figure 2:
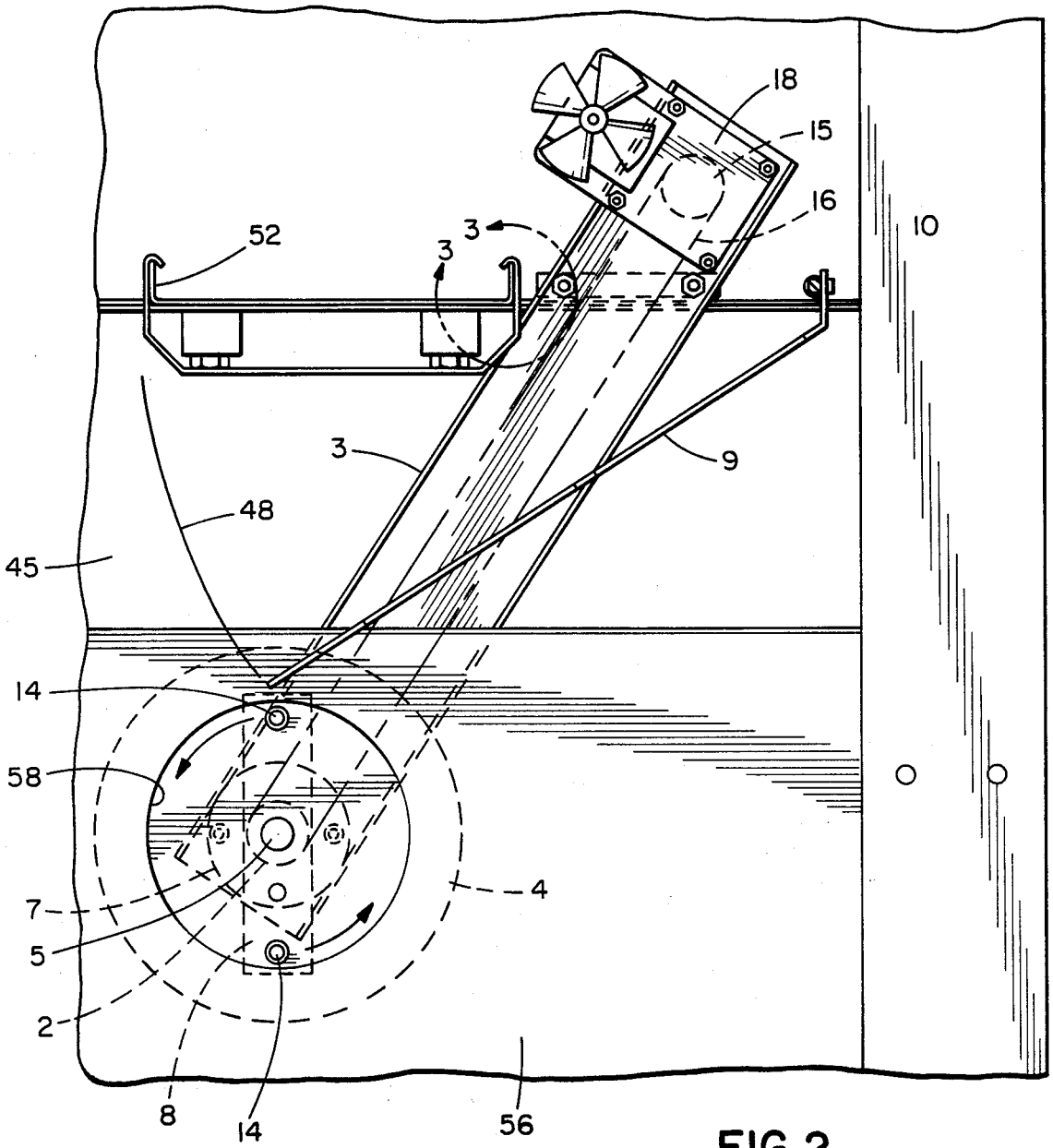
FIG. 2 is an end elevation view of the preferred embodiment.
Figure 3:
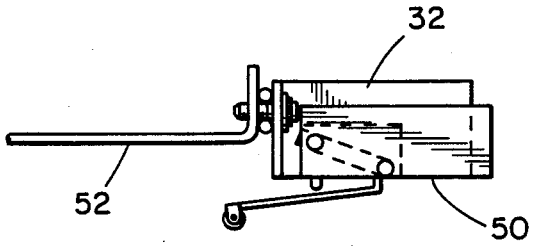
FIG. 3 is a detail view of a microswitch of the preferred embodiment located in the area encircled and designated 3—3 in FIG. 2.

The trimwinder rods 14 rotate counterclockwise as shown in FIG. 2, winding trim thereabout. As the trim accumulates, the plate 9 wipingly presses the trim about the rods 14, tightening the trim thereabout. The plate 9 pivots gradually away from the rods 14 as it rides over the trim. As in FIG. 2, the end of the plate 9 traces an arc 48. At a position corresponding to the rods 14 having a capacity of trim, the plate 9 contacts a pair of microswitches such as microswitch 50, shown in FIG. 3. The switches 50 are secured by their brackets 32 to the frame, and more specifically to a cross tie channel 52 extending parallel to the rods 14.

The microswitches 50 control, in part, the motor 18. They stop the motor 18 when the levers of the switches are contacted by the plate 9.

The trim wound about the rods 14 is then removed. As shown best in FIG. 1, the rods 14 extend within a bin 42 of the rewinder. The plate 8 and cover plate 4 are outside the bin 42. A portion of the sidewall 56 of the bin 42 defines a circular opening 58 for the rods 14, larger in diameter than the diameter of the circle traced by rotation of the rods 14, and smaller than the diameter of the cover plate 4. The bin is removed from the rewinder by being pulled therefrom parallel to the rods 14. The portion of the sidewall 56 about the opening 58 constitutes a stripper, stripping the trim from the rods 14 as the bin 42 is pulled from the rewinder. The trim does not leave the bin 42, and remains as tightly wound about the rods 14.

The invention, and the manner and process of making and using it, are now described in such full, clear, concise and exact terms as to enable any person skilled in the art to which it pertains, to make and use the same. It is to be understood, of course, that the foregoing describes a preferred embodiment of the present invention and that modifications may be made therein without departing from the spirit or scope of the present invention as set forth in the claims. To particularly point out and distinctly claim the subject matter regarded as invention, the following claims conclude this specification.

We regard as invention and claim:

1. A waste paper trim rewinder comprising:

a frame;

waste paper trim rewind means including elongated members rotatably mounted on the frame for rewinding trim;

an open top waste paper bin removably mounted on the frame and adapted to strip the waste paper trim from the elongated members into the waste paper bin, upon removal of the waste paper bin;

the waste paper bin having a trim stripper portion defining a member opening for the elongated members, the elongated members extending through the member opening when the waste paper bin is mounted on the frame, the elongated members being movable through the member opening during removal of the waste paper bin, and the trim stripper portion being sized to strip the waste paper trim from the elongated members as the elongated members move through the member opening;

a compacting means including a pressure member movably mounted on the frame for compacting the waste paper trim on the elongated members;

the pressure member being a pressure plate pivotably mounted on the frame and adapted to wipingly press against waste paper trim on the elongated members to tighten the trim on the elongated members; and means for sensing the position of the movable pressure member and controlling the rewind means in relation to said position;

the sensing and controlling means being for stopping the rewind means when the position of the pressure member corresponds to the trim rewinder being full of waste paper trim.

2. A waste paper trim rewinder as in claim 1 in which the rewind means includes drive means on the frame for drivably rotating the elongated members and in which the sensing and controlling means includes switches secured to the frame in the path of the pressure plate as the pressure plate pivots and at positions corresponding to the elongated members having a capacity of waste paper trim thereon, the switches operatively connected to the drive means and stopping the drive means upon contact of the switches by the pressure plate.

3. A waste paper trim rewinder as in claim 1 in which the elongated members extend through the bin only at the member opening, and in which the waste paper trim rewind means includes a cover plate having a size greater than the members opening, the cover plate being exterior to the bin, and adjacent the member opening when the waste paper bin is mounted on the frame.

4. A continuous business form assembly waste paper trim rewinder comprising:

a frame with at least a frame member;

a shaft with an axis, the shaft being bearing mounted for rotation to the frame member;

a trimwinder plate mounted to the shaft for rotation therewith;

a cover plate mounted to the trimwinder plate;

a plurality of elongated trimwinder rods mounted to the trimwinder plate for rotation with the plates and shaft, the trimwinder rods extending substantially parallel to the shaft and being for rewinding the waste paper trim;

a drive means operatively connected to the shaft for driving the shaft and thereby the plates and trimwinder rods in rotation about the axis;

a pressure plate rod extending offset from and substantially parallel to the axis of the shaft, the pressure plate rod rotatably mounted to the frame;

a pressure plate extending parallel to the axis and affixed to the pressure plate rod for rotation therewith, the pressure plate extending into riding contact with waste paper trim being rewound on the trimwinder rods and wipingly pressing and tightening the trim about the trimwinder rods, the pressure plate pivoting through an arc as the pressure plate rides upon the waste paper trim;

an open top waste paper bin manually removably mounted on the frame and having a sidewall with a portion thereof being a waste paper trim stripper defining an opening for the trimwinder rods, the opening being covered exteriorly by the cover plate when the waste paper bin is mounted on the frame and the trimwinder rods extending through the opening for rotation within the bin when the bin is mounted on the frame, the trimwinder rods being movable through the opening during removal of the bin off the frame, and the trim stripper portion being sized relative to rotating positions of the trimwinder rods to strip waste paper trim from the trimwinder rods as the trimwinder rods move through the opening during removal of the waste paper bin;

switches secured to the frame in the path of the pressure plate as the pressure plate pivots and at positions corresponding to the elongated members having a capacity of waste paper trim thereon, the switches operatively connected to the drive means and stopping the drive means upon contact of the switches by the pressure plate.

* * * * *